US006350110B1

(12) United States Patent
Martin

(10) Patent No.: US 6,350,110 B1
(45) Date of Patent: Feb. 26, 2002

(54) MULTIPORT METERING PUMP

(75) Inventor: Kirk Alan Martin, Aptos, CA (US)

(73) Assignee: B&G International, Aptos, CA (US)

( * ) Notice: Subject to any disclaimer, the term of this patent is extended or adjusted under 35 U.S.C. 154(b) by 0 days.

(21) Appl. No.: 09/540,485

(22) Filed: Mar. 31, 2000

(51) Int. Cl.[7] ..... F04B 43/06; F04B 45/00
(52) U.S. Cl. ..... 417/395; 417/413.1
(58) Field of Search ..... 417/395, 413.1, 417/388, 397

(56) References Cited

U.S. PATENT DOCUMENTS 3,814,548 A * 6/1974 Rupp ..... 417/395
4,583,920 A * 4/1986 Lindner ..... 417/266
4,619,589 A * 10/1986 Muller et al. ..... 417/388
4,828,464 A * 5/1989 Maier et al. ..... 417/388
5,056,036 A * 10/1991 Van Bork ..... 364/510
5,249,932 A * 10/1993 Van Bork ..... 417/386
5,279,504 A * 1/1994 Williams ..... 417/393

* cited by examiner

*Primary Examiner*—Teresa Walberg
*Assistant Examiner*—Thor Campbell
(74) *Attorney, Agent, or Firm*—Skjerven Morrill MacPherson LLP; David E. Steuber

(57) ABSTRACT

The present invention is directed to a multiport metering pump that can completely deliver a very small volume of liquid. The multiport metering pump includes a number of ports (or valve units), each of which can be used as either an outlet valve or an inlet valve. The multiport metering pump includes: a central gallery; a displacement unit; multiple valve units; and multiple conduits that respectively connect the displacement unit and the valve units to the central gallery. The displacement unit and the valve units communicate with the central gallery, and any of the valve units can be used as an inlet valve or outlet valve for the liquid delivery.

21 Claims, 5 Drawing Sheets

MULTIPORT METERING PUMP

BACKGROUND

1. Field of the Invention

This invention relates to a liquid flow controller and more particularly, to a multiport metering pump that can deliver a small quantity of liquid.

2. Description of Related Arts

Accurate control of liquid delivery is required in many industrial equipment for chemical analysis and process control applications. Thus, a number of methods for accurate delivery have been developed for industrial purposes.

A liquid flow controller employs a sensor to measure flow rate of a liquid. The sensor informs a servo valve of the flow rate, and then the servo-valve adjusts the flow rate. Describing the process in more detail, the sensor utilizes a diode emitting infrared light, a photo diode detecting light, and a Pelton type turbine wheel to determine the flow rate of the liquid. Light from the diode is alternately reflected and absorbed from spokes deposited on the turbine wheel, and energy of the reflected light is detected by the photo diode. Thus, as the turbine wheel rotates in response to flow rate, electrical pulses are generated. According to the electrical pulses, processing circuitry provides a DC voltage output proportional to the flow rate. Then, a bi-directional linear stepper motor moves a micro-flow control valve of the servo valve in response to any difference between the desired flow and the actual flow rate.

Another liquid flow controller employs a variable stroke electromagnetic valve featuring a valve seat design which permits increasing or decreasing the flow rate of a liquid in response to variable input power. Input power generated from a flow rate detector is intermittently applied to a valve coil of the electromagnetic valve. When the input power is applied, energy in the coil increases, and when it is discontinued, energy stored in the coil maintains the magnetic flux level required to hold flow at a controlled rate. This cycle takes place many thousands of times per second. By using a variable DC power supply, the valve opening can be adjusted proportional to the supplied power.

The above-described controllers may precisely control the flow rate of a liquid, delivering the liquid from a container connected to an inlet port of the controllers to another container connected to an outlet port of the controllers. However, in particular cases, a liquid flow controller may need to deliver various kinds of liquids contained in different containers. Accordingly, such particular applications demand a liquid flow controller to have multiports for delivering various liquids, each port of the multiports can be used as an inlet or outlet port.

SUMMARY

The present invention is directed to a multiport metering pump that can completely deliver a very small volume of liquid. The multiport metering pump includes a number of ports (or valve units), each of which can be used as either an outlet valve or an inlet valve.

In accordance with an embodiment of the invention, the multiport metering pump includes: a central gallery; a displacement unit; multiple valve units; and multiple conduits that respectively connect the displacement unit and the valve units to the central gallery. The displacement unit and the valve units communicate with the central gallery, and any of the valve units can be used as an inlet valve or outlet valve for the liquid delivery.

The displacement unit includes: an upper body; a lower body; a displacement unit diaphragm which is sealed between the lower body and the upper body so as to form a displacement unit cavity; and a conduit port. The conduit port is formed in the lower body so as to allow the liquid to flow between the displacement unit cavity and the central gallery through one of the conduits. The displacement unit diaphragm moves up and down so as to open and close the conduit port. The displacement unit diaphragm is in a disk shape. The middle portion of the displacement unit diaphragm is thin and flexible so that the central portion of the displacement unit diaphragm can move up and down so as to open and close the conduit port while the outer portion of the displacement unit diaphragm is fixed between the upper body and the lower body.

The displacement unit further includes a circular groove around the open cavity of the lower body, an actuator, and a securing screw piston. The outer portion of the displacement unit diaphragm sits in the circular groove, and the actuator piston drives the displacement unit diaphragm to move up and down. The securing screw connects the actuator piston to the displacement unit diaphragm.

Each of the valve units includes: an upper body; a lower body; a valve unit diaphragm which is sealed between the lower body and the upper body to form a valve unit cavity; an inlet/outlet port; a conduit port; and a valve seat formed around the conduit port. The valve unit diaphragm moves up and down so as to open and close the conduit port. Through the inlet/outlet port, liquid flows between the valve unit cavity and an external container connected to the valve unit. The conduit port is formed in the lower body so as to allow the liquid to flow between the valve unit cavity and the central gallery through one of the conduits The valve seat is in a conical shape, and the valve unit diaphragm includes: a central portion; a middle portion that surrounds the central portion; and an outer portion that surrounds the middle portion and is fixed between the upper body and the lower body. The central portion is in a hemispherical shape so as to fit in the conical valve seat to seal the valve unit cavity from the conduit port. The middle portion is thin and flexible so that the central portion can move up and down so as to open and close the conduit port while the outer portion is fixed between the upper body and the lower body.

Each of the valve unit further includes a circular groove around the open cavity of the lower body, an actuator, and a securing screw piston. The outer portion of the valve unit diaphragm sits in the circular groove, and the actuator piston drives the valve unit diaphragm to move up and down. The securing screw connects the actuator piston to the valve unit diaphragm.

In addition, the actuator pistons of the valve units and the displacement unit are driven by a pneumatic system. The upper bodies, the lower bodies, and the diaphragms of the valve units and the displacement unit are made of PTFE Teflon™.

BRIEF DESCRIPTION OF THE DRAWINGS

Use of same numbers in different figures indicates similar or identical items.

DETAILED DESCRIPTION OF THE PREFERRED EMBODIMENTS

An aspect of the present invention provides a multiport metering pump that can completely deliver a very small volume of liquid. The multiport metering pump includes a number of ports (or valve units), each of which can be used as either an outlet valve or an inlet valve.

Figure 1:
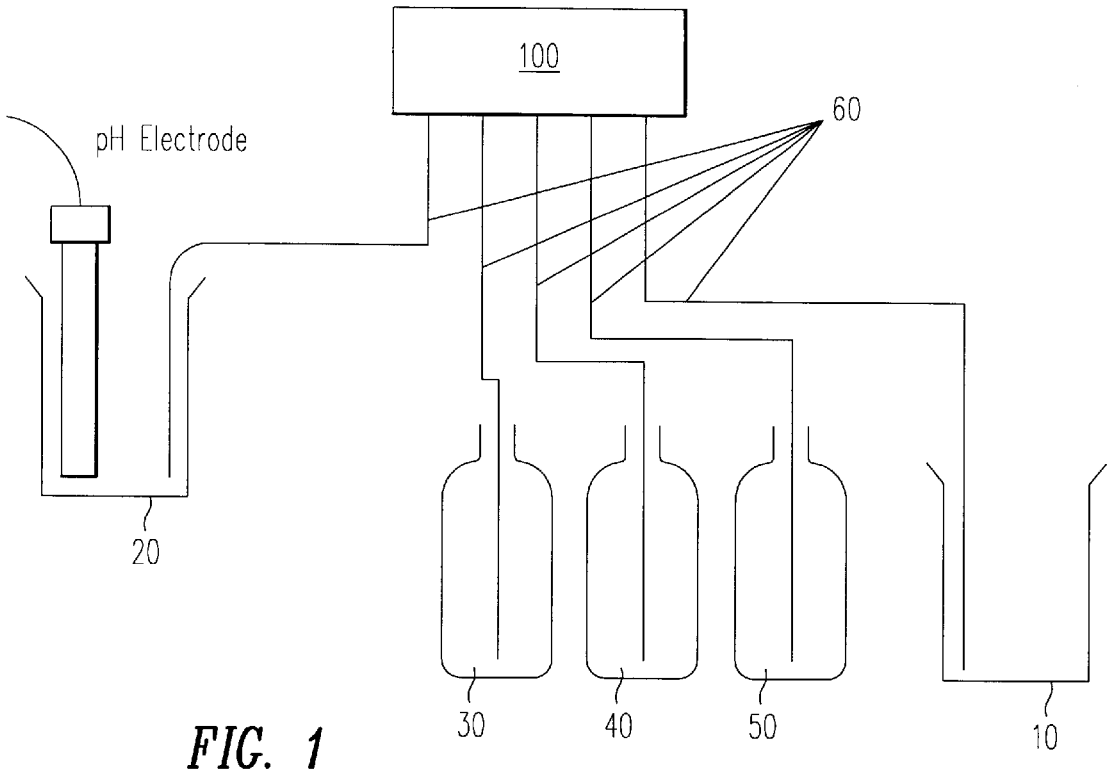
FIG. 1 is a schematic diagram of an automated chemical analysis system that employs a multiport metering pump in accordance with an embodiment of the present invention.

The multiport metering pump can be used in chemical analysis and process control applications. FIG. 1 illustrates an automated chemical analysis system that employs a multiport metering pump 100 in accordance with an embodiment of the present invention. In a chemical analysis of a chemical in a plating bath 10, multiport metering pump 100 transfers a portion of the chemical from plating bath 10 to a reaction vessel 20. Then, multiport metering pump 100 transfers a fixed amount of DI water 40 to reaction vessel 20 to cleanse the chemical remaining inside multiport metering pump 100 and a transporting line 60 between reaction vessel 20 and multiport metering pump 100. The pH of the chemical in reaction vessel 20 is monitored as multiport metering pump 100 pumps a titrating fluid 30 to reaction vessel 20 until the pH reaches a preset value. When the pH reaches the preset value, the number of pumping cycles (or the volume of titrating fluid 30 pumped into reaction vessel 20) is calculated and recorded. Multiport metering pump 100 then pumps the chemical in reaction vessel 20 to a waste bath 50, and for a next chemical analysis, refills reaction vessel 20 with DI water 40 and pumps the DI water 40 in reaction vessel 20 out to waste bath 50.

Figure 2:
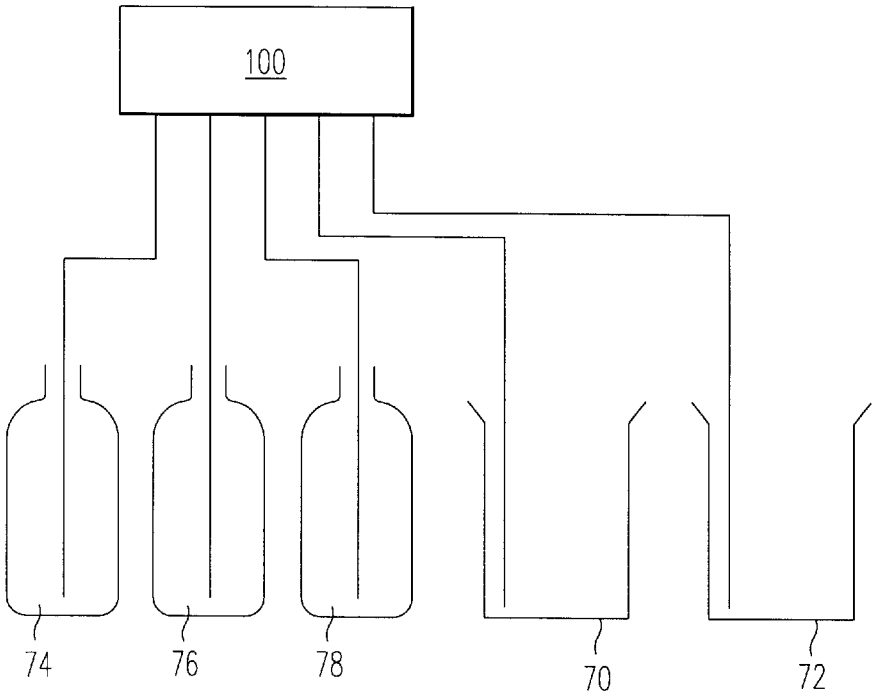
FIG. 2 is a schematic diagram of a plating system that employs the multiport metering pump of FIG. 1.

FIG. 2 illustrates an "add back" plating system that employs multiport metering pump 100. The system includes multiport metering pump 100, two plating baths 70 and 72, and three chemical containers 74, 76, and 78 that supply chemical elements to plating baths 70 and 72. For example, when plating baths 70 and 72 are for Fe—Ni (Iron-Nickel) plating, three chemical containers 74, 76, and 78 respectively contain Ni solution, Fe solution, and sulfuric acid. During the plating, whenever the plating solution plating baths 70 and 72 become depleted of the chemical elements for the plating, multiport metering pump 100 replenishes the depleted chemical elements by pumping the elements from chemical containers 74, 76, and 78 to plating baths 70 and 72.

Figure 3:
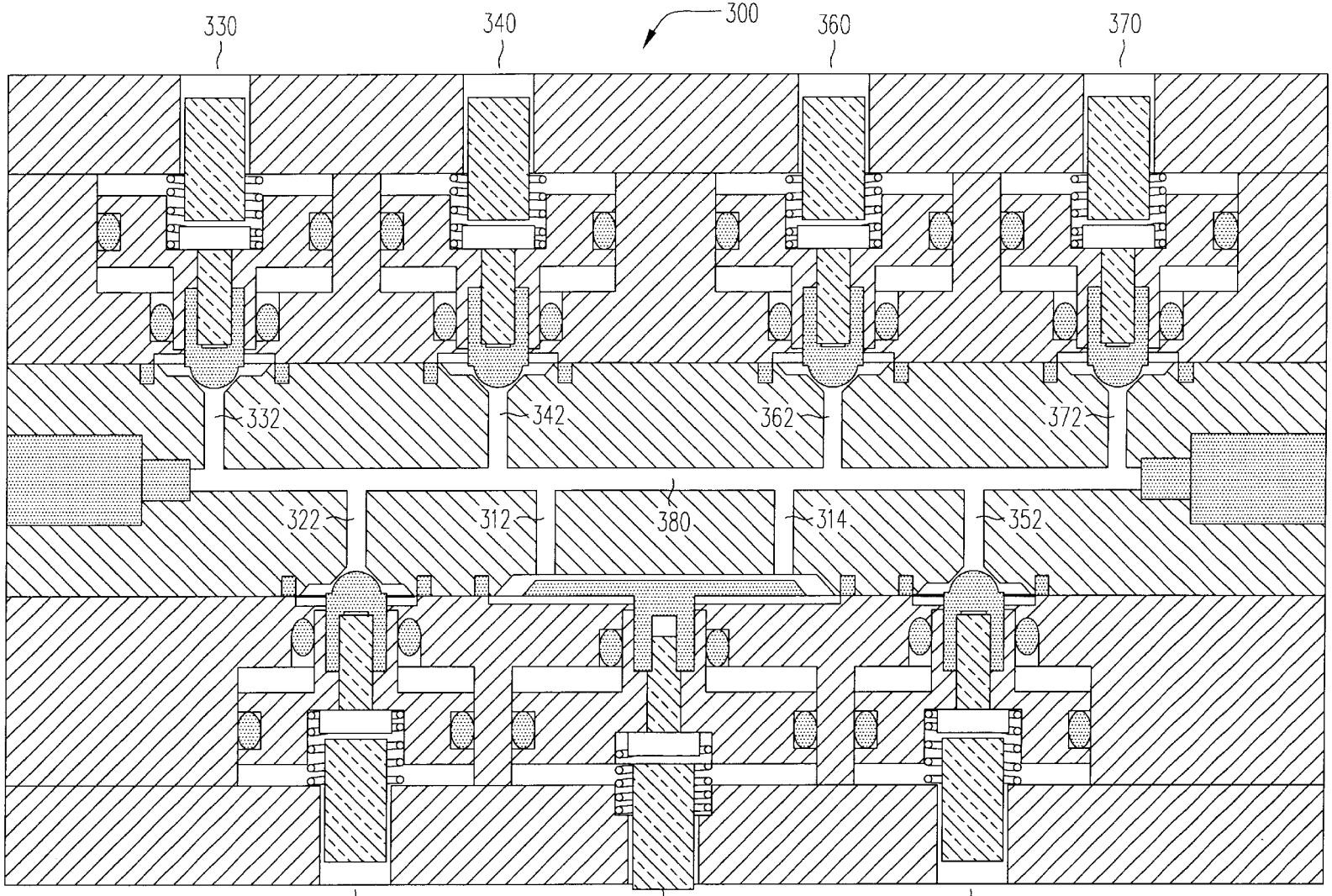
FIG. 3 is a sectional view of a multiport metering pump in accordance with an embodiment of the present invention.

FIG. 3 illustrates a multiport metering pump 300, which is an embodiment of multiport metering pump 100 of FIG. 1. Multiport metering pump 300 includes a displacement unit 310, six valve units 320, 330, 340, 350, 360, and 370, a central gallery 380, and eight conduits 312, 314, 322, 332, 342, 352, 362, and 372. Conduits 312 and 314 connect displacement unit 310 to central gallery 380, and conduits 322, 332, 342, 352, 362, and 372 respectively connect valve units 320, 330, 340, 350, 360, and 370 to central gallery 380.

Figure 4:
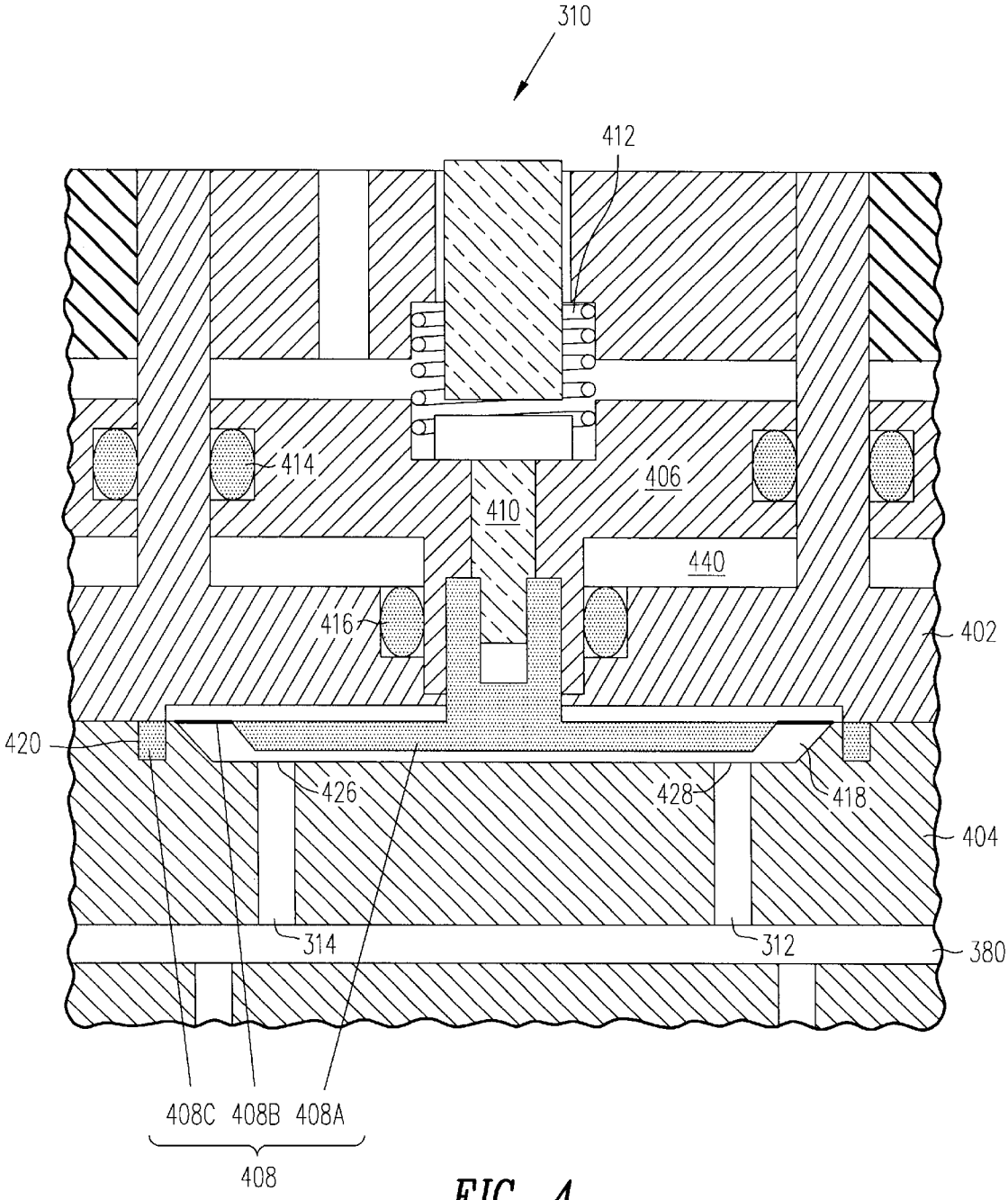
FIG. 4 is a sectional view of a displacement unit of the multiport metering pump of FIG. 3.

FIG. 4 illustrates a detailed view of displacement unit 310 of FIG. 3, which can deliver a small volume of liquid with a high degree of precision. Displacement unit 310 includes a diaphragm 408, an upper body 402, and a lower body 404. Upper body 402 and lower body 404 form a cylindrical cavity in displacement unit 310, in which a pneumatic actuator piston 406 and diaphragm 408 move. Lower body 404 includes two conduit ports 426 and 428 that respectively connect to conduits 314 and 312. Diaphragm 408 is fixed to pneumatic actuator piston 406 by a securing screw 410 such that diaphragm 408 moves up and down with pneumatic actuator piston 406. Displacement unit 310 further includes a displacement unit closing spring 412 supporting pneumatic actuator piston 406, an upper piston seal 'O' ring 414, and a lower piston seal 'O' ring 416. An upper portion of diaphragm 408 is fixed in pneumatic actuator piston 406, and a lower portion of diaphragm 408, which is shaped like a disk, forms a displacement cavity 418 with lower body 404. The lower portion of diaphragm 408 is composed of a central portion 408A, a middle portion 408B, and an outer portion 408C. Diaphragm 408 is formed in one piece.

Central portion 408A is a circular thin solid block, middle portion 408B is a thin circular membrane that is thinner than central portion 408A, and outer portion 408C, which is called a tongue, is a circular ring thicker than middle portion 408B. Outer portion 408C is fixed in a circular groove 420 of lower body 404, so that diaphragm 408 is clamped between upper body 402 and lower body 404. Since middle portion 408B is thin and flexible, central portion 408A can move a small distance up and down to open and close conduits 312 and 314. Displacement cavity 418 holds the fluid from central gallery 380. When diaphragm 408 moves up and down, the fluid flows from and into central gallery 380 through conduits 312 and 314

Upper body 402, lower body 404, pneumatic actuator piston 406, and diaphragm 408 are made of PTFE Teflon™. Upper body 402 connects to a system (not shown) for driving pneumatic actuator piston 406, and conduits 312 and 314 are formed in lower body 404. The system for driving for pneumatic actuator piston 406 is a pneumatic system using solenoid valves. The system is described in U.S. patent application Ser. No. 09/383,063, which is herein incorporated as a reference in its entirety.

The system drives pneumatic actuator piston 406 by applying an air pressure into a chamber 440 through an air conduit (not shown). When displacement unit 310 is at rest, displacement unit closing spring 412 extends, so that central portion 408A of diaphragm 408 contacts lower body 404. Applying and releasing the air pressure moves pneumatic actuator piston 406 upward and downward, and contracts and extends displacement unit closing spring 412.

Upper piston seal 'O' ring 414 is within a closed space between pneumatic actuator piston 406 and upper body 402. However, lower piston seal 'O' ring 416 is in a space between pneumatic actuator piston 406 and upper 402, which is open upward. The movement of pneumatic actuator piston 406 and the air pressure applied into chamber 440 keep lower piston seal 'O' ring 416 in the open space. When the air pressure is applied into chamber 440 to move pneumatic actuator piston 406 upward, the air pressure keeps lower piston seal 'O' ring 416 in the open space. In contrast, when the air pressure is released to move pneumatic actuator piston 406 downward, the downward movement of pneumatic actuator piston 406 keeps lower piston seal 'O' ring 416 in the open space.

Valve units 320, 330, 340, 350, 360, and 370 basically have the same structure. Although illustrating the structure of valve unit 320, FIG. 5 can be the structure of valve units 330, 340, 350, 360, and 370.

Figure 5:
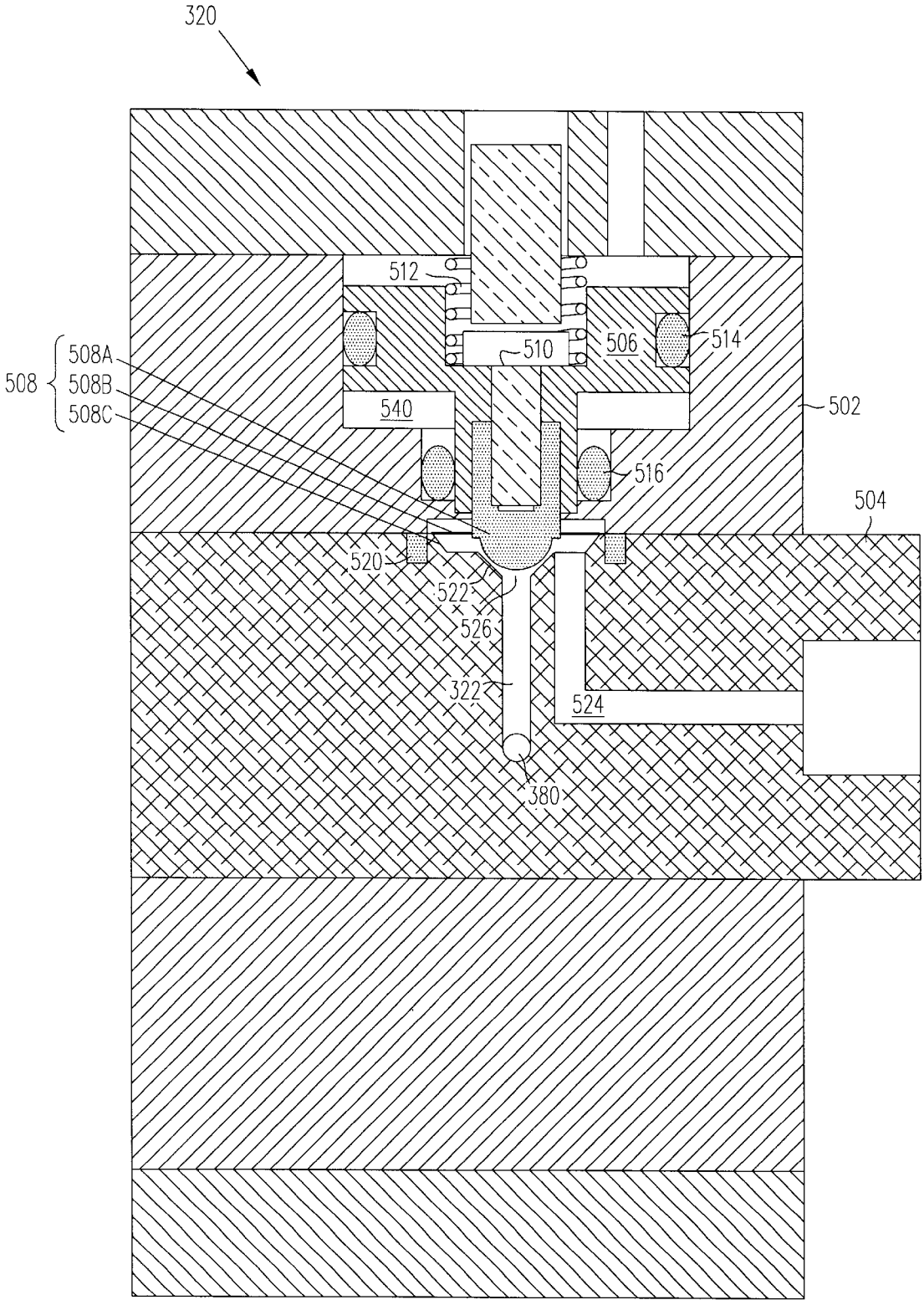
FIG. 5 is a sectional view of a valve unit of the multiport metering pump of FIG. 3.
Figure 6:
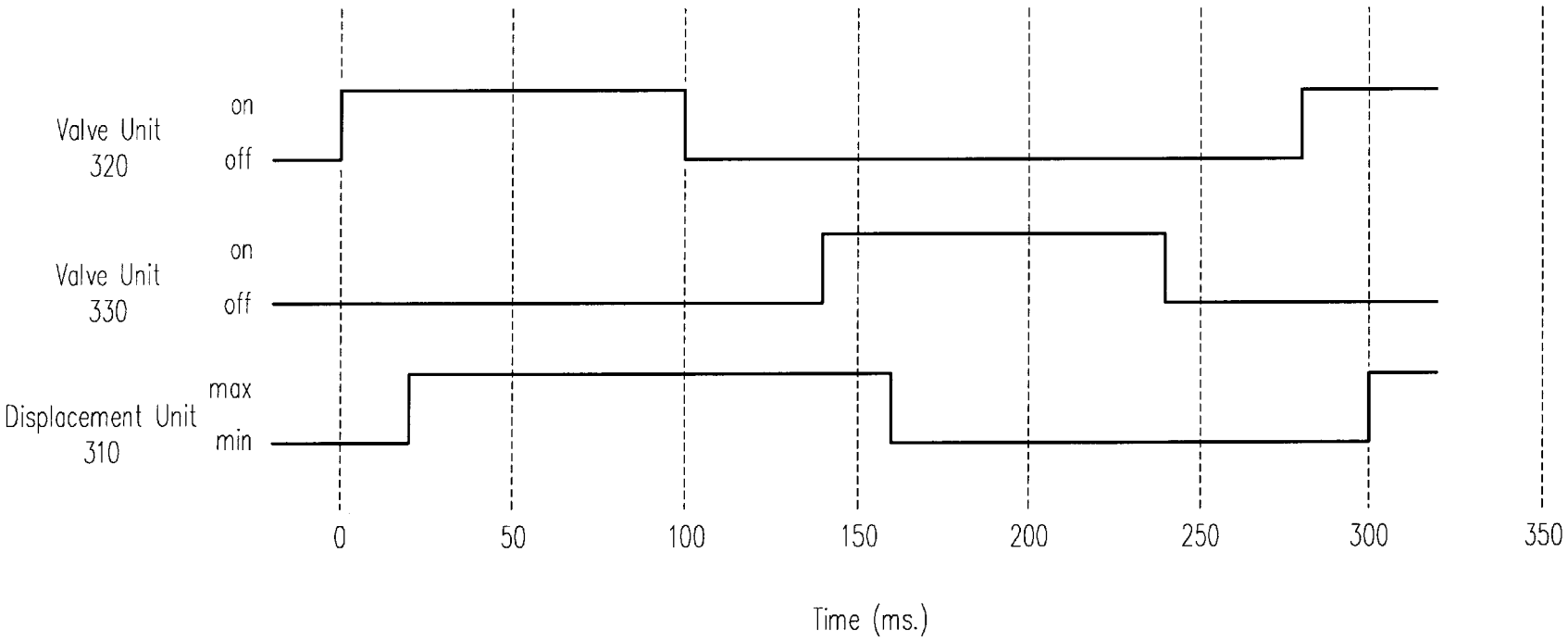
FIG. 6 is an operation timing diagram of the multiport metering pump of FIG. 3.

Referring to FIG. 5, valve unit 320 includes an upper body 502 and a lower body 504 to form a cylindrical cavity in valve unit 320, in which a pneumatic actuator piston 506 and a valve unit diaphragm 508 move. FIG. 5 is a cross-sectional view taken at a right angle to the section of FIG. 3. Upper body 502 and lower body 504 can be either separate from or integrated into upper body 402 and a lower body 404, respectively, of FIG. 4. Lower body 504 has a conduit port 526 that connects to conduit 322. Conduit port 526 is often formed at the center of the lower body 504. Valve unit diaphragm 508 is fixed to pneumatic actuator piston 506 by a securing screw 510 such that diaphragm 508 moves up and down with pneumatic actuator piston 506. Valve unit 320 further includes a valve unit closing spring 512 supporting pneumatic actuator piston 506, an upper piston seal 'O' ring 514, and a lower piston seal 'O' ring 516. An upper portion of diaphragm 508 is fixed in pneumatic actuator piston 506, and a lower portion of diaphragm 508, which is shaped like a hemisphere surrounded by a circular membrane, forms a valve cavity 518 with lower body 504. The lower portion of diaphragm 508 is composed of a central portion 508A, a middle portion 508B, and an outer portion 508C. Diaphragm 508 is formed in one piece.

Central portion 508A of diaphragm 508 is a solid hemispherical block, middle portion 508B is a thin circular membrane, and outer portion 508C, which is called a tongue, is a circular ring thicker than middle portion 508B. Outer portion 508C is fixed in a circular groove 520 of lower body 504, so that diaphragm 508 is clamped between upper body 502 and lower body 504. Since middle portion 508B is thin and flexible, central portion 508A can move a small distance up and down to open and close conduit 322.

Valve unit 320 further includes an inlet/outlet port 524 and a conical valve seat 522 formed around conduit port 526 in lower body 504. Inlet/outlet port 524 is not visible in FIG. 3 because inlet/outlet port 524 is in the third dimension from the plane of the paper. Through inlet/out port 524, which is positioned off-center from conical valve seat 522, a fluid flows into and out of valve cavity 418. A container (not shown) containing the fluid connects to inlet/outlet port 524. When diaphragm 508 moves down, central portion 508A of diaphragm 508 presses conical valve seat 522, so that valve cavity 418 is completely sealed from conduit 322 and central gallery 380 (FIG. 3). For complete sealing, central portion 508A of diaphragm 508 and conical valve seat 522 may be slightly deformed while diaphragm 508 presses conical valve seat 522. When diaphragm 508 moves up, the fluid can flow from and into central gallery 380 through conduit 322, and central portion 508A of diaphragm 508 and conical valve seat 522 restore their original shapes.

Upper body 502, lower body 504, pneumatic actuator piston 506, and diaphragm 508 can be made of PTFE Teflon™. Upper body 502 connects to a system (not shown) for driving pneumatic actuator piston 506, and conduit 322 is formed in lower body 504. The system for driving pneumatic actuator piston 506 is similar to the system for driving pneumatic actuator piston 406 of FIG. 4.

The system drives pneumatic actuator piston 506 by applying air pressure into a chamber 540 through an air conduit (not shown). When valve unit 320 is at rest, valve unit closing spring 512 extends, so that central portion 508A of diaphragm 508 contacts lower body 504. Applying and releasing the air pressure moves pneumatic actuator piston 506 upward and downward, and contracts and extends valve unit closing spring 512.

Upper piston seal 'O' ring 514 is within a closed space between pneumatic actuator piston 506 and upper body 502. However, lower piston seal 'O' ring 516 is in a space between pneumatic actuator piston 506 and upper 502, which is open upward. The movement of pneumatic actuator piston 506 and the air pressure applied into chamber 540 keep lower piston seal 'O' ring 516 in the open space. When the air pressure is applied into chamber 540 to move pneumatic actuator piston 506 upward, the air pressure keeps lower piston seal 'O' ring 516 in the open space. In contrast, when the air pressure is released to move pneumatic actuator piston 506 downward, the downward movement of pneumatic actuator piston 506 keeps lower piston seal 'O' ring 516 in the open space.

Referring to FIG. 3, multiport metering pump 300 can deliver the fluid from one to another of valve units 320, 330, 340, 350, 360, and 370. When at rest, that is, before delivering a liquid, all valve units 320 to 370 are closed, and displacement unit 310 is in the minimum volume position. In other words, diaphragms 508 (FIG. 5) of valve units 320 to 370 close conduits 322, 332, 342, 352, 362, and 372, and diaphragm 408 (FIG. 4) of displacement unit 310 closes conduits 312 and 314. If a liquid is to be delivered from valve unit 320 to valve unit 330, for example, the fluid flows through valve unit 320, central gallery 380 and valve unit 330.

Referring to FIGS. 3 to 6, a liquid delivery sequence of multiport metering pump 300 from valve unit 320 to valve unit 330 is explained. During this delivery, valve units 340, 350, 360, and 370 are closed because they do not participate in the delivery.

In the first step, pneumatic actuator piston 406 of valve unit 320 opens valve unit 320, valve unit 330 is closed, and displacement unit 310 is in its minimum volume position. Then, after a short period of time, while valve unit 330 is still closed, displacement unit 310 is moved to its maximum volume position. The movement of displacement unit 310 to its maximum volume position creates negative pressure inside multiport metering pump 300, and a fluid in a bath or container (not shown) flows through inlet/outlet port 524 of valve unit 320 and conduit 320 and fills central gallery 380, conduits 312, 314, 322, 332, 342, 352, 362, and 372, and displacement cavity 418 of displacement unit 310. The initial filling of central gallery 380, conduits 312, 314, 322, 332, 342, 352, 362, and 372, and displacement cavity 418 of displacement unit 310 takes at least one liquid delivery cycle for expelling the air or gas inside multiport metering pump 300.

In the second step, after a period of time in which the pumped fluid moves into displacement cavity 418, valve unit 320 is closed. Accordingly, two valve units 320 and 330 are closed, displacement unit 310 is in its maximum pump cavity volume position, and the liquid is still in displacement cavity 418 of displacement unit 310, central gallery 380, and conduits 312, 314, 322, 332, 342, 352, 362, and 372.

Third step delivers the fluid to a bath or container (not shown) through valve unit 330 by opening valve unit 330. After a short period of time after valve unit 320 is closed, valve unit 330 is activated to open. Then, displacement unit 310 moves to its minimum volume position. Accordingly, the fluid having a volume of displacement cavity 418 is delivered through inlet/outlet port 524 of valve unit 330 to the bath connected to valve unit 330. Finally, after the fluid is delivered, valve unit 330 is closed to end one liquid delivery cycle.

As mentioned above, any of valve units 320 to 370 may be designated at any time as an inlet valve or an outlet valve of another liquid delivery cycle, the sequence of which is similar to the liquid delivery sequence mentioned above. For instance, two of valve units 320 to 370 can be designated as inlet valves, and another one of valve units 320 to 370 can be designated as an outlet valve. In another instance, two of valve units 320 to 370 can be designated as inlet valves, and another three of valve units 320 to 370 can be designated as outlet valves. Many inlet-outlet valve combinations are possible. In these cases, all inlet valves operate in the same operation time sequence, and all outlet valves operate in another same operation time sequence.

As described above, the present invention provides a multiport metering pump that can deliver liquid at a constant flow rate because the volume of the delivered liquid in a delivery cycle is determined by a cavity volume of a displacement unit of the multiport metering pump. The cavity volume can be as small as present machining technology can achieve. Further, the multiport metering pump can select any of the valve units as an inlet valve or outlet valve in the liquid delivery. Finally, the number of conduits from the displacement unit can be varied to control the speed of liquid delivery. More conduits of the displacement unit will result in faster delivery speed. In addition, higher operation speed also will result in faster delivery speed.

Although the invention has been described with reference to particular embodiments, the description is an example of the invention's application and should not be taken as a limitation. Various adaptations and combinations of the features of the embodiments disclosed are within the scope of the invention as defined by the following claims.

I claim:

1. An apparatus for delivering a liquid, comprising:

a central gallery;

a displacement unit;

at least three valve units; and a plurality of conduits that respectively connect the displacement unit and the valve units to the central gallery, so that the displacement unit and the valve units communicate with the central gallery, wherein any of the valve units can be used as an inlet valve or outlet valve for the liquid.

2. The apparatus of claim 1, wherein the displacement unit comprises:

an upper body;

a lower body having an open cavity;

a displacement unit diaphragm which is sealed between the lower body and the upper body so that the open cavity becomes a displacement unit cavity that can hold the liquid; and a conduit port which is formed in the lower body so as to allow the liquid to flow between the displacement unit cavity and the central gallery through one of the conduits, wherein the displacement unit diaphragm moves up and down so as to open and close the conduit port.

3. The apparatus of claim 2, wherein the displacement unit diaphragm is in a disk shape and comprises:

a central portion;

a middle portion that surrounds the central portion; and an outer portion that surrounds the middle portion and is fixed between the upper body and the lower body, wherein the middle portion is thin and flexible so that the central portion can move up and down so as to open and close the conduit port while the outer portion is fixed between the upper body and the lower body.

4. The apparatus of claim 3, wherein the lower body further comprises a circular groove around the open cavity, so that the outer portion of the displacement unit diaphragm sits in the circular groove.

5. The apparatus of claim 2, further comprising an actuator piston that drives the displacement unit diaphragm to move up and down, wherein the actuator piston moves inside a cavity in the upper body.

6. The apparatus of claim 5, further comprising a securing screw that connects the actuator piston to the displacement unit diaphragm.

7. The apparatus of claim 5, wherein the actuator piston is driven by a pneumatic system.

8. The apparatus of claim 5, further comprising a chamber formed between the upper body and the actuator piston, wherein an air pressure is applied into the chamber so as to move the actuator piston.

9. The apparatus of claim 8, further comprising a piston seal 'O' ring that surrounds the actuator piston and is placed in a groove formed between the actuator piston and the upper body, wherein the piston seal 'O' ring is exposed to the chamber.

10. The apparatus of claim 2, wherein the upper body, the lower body, and the displacement unit diaphragm are made of PTFE Teflon™.

11. The apparatus of claim 1, wherein each of the valve units comprises:

an upper body;

a lower body having an open cavity;

a valve unit diaphragm which is sealed between the lower body and the upper body so that the open cavity becomes a valve unit cavity that can hold the liquid;

an inlet/outlet port through which the liquid flows between the valve unit cavity and an external container connected to the valve unit;

a conduit port which is formed in the lower body so as to allow the liquid to flow between the valve unit cavity and the central gallery through one of the conduits; and a valve seat formed around the conduit port in the lower body, wherein the valve unit diaphragm moves up and down so as to open and close the conduit port.

12. The apparatus of claim 11, wherein the valve seat is in a conical shape, and the valve unit diaphragm is in a disk shape and comprises:

a central portion;

a middle portion that surrounds the central portion; and an outer portion that surrounds the middle portion and is fixed between the upper body and the lower body, wherein the central portion is in a hemispherical shape so as to fit in the conical valve seat to seal the valve unit cavity from the conduit port, and the middle portion is thin and flexible so that the central portion can move up and down so as to open and close the conduit port while the outer portion is fixed between the upper body and the lower body.

13. The apparatus of claim 12, wherein the lower body further comprises a circular groove around the open cavity, so that the outer portion of the valve unit diaphragm sits in the circular groove.

14. The apparatus of claim 11, further comprising an actuator piston that drives the valve unit diaphragm to move up and down, wherein the actuator piston moves inside a cavity in the upper body.

15. The apparatus of claim 14, further comprising a securing screw that connects the actuator piston to the valve unit diaphragm.

16. The apparatus of claim 14, wherein the actuator piston is driven by a pneumatic system.

17. The apparatus of claim 14, further comprising a chamber formed between the upper body and the actuator piston, wherein an air pressure is applied into the chamber so as to move the actuator piston.

18. The apparatus of claim 17, further comprising a piston seal 'O' ring that surrounds the actuator piston and is placed in a groove formed between the actuator piston and the upper body, wherein the piston seal 'O' ring is exposed to the chamber.

19. The apparatus of claim 11, wherein the upper body, the lower body, and the valve unit diaphragm are made of PTFE Teflon™.

20. An apparatus for delivering a liquid, comprising:

a body having a cylindrical inner space;

a piston that moves up and down in the cylindrical inner space;

a chamber formed between the body and the piston and in the cylindrical inner space;

a piston seal 'O' ring that surrounds the piston and is placed in a groove formed between the piston and the upper body, the piston seal 'O' ring being exposed to the chamber, wherein a pressure applied into the chamber drives the piston up and down.

21. A method for delivering a liquid in an apparatus, which comprises: a central gallery; a displacement unit; at least three valve units; and a plurality of conduits that respectively connect the displacement unit and the valve units to the central gallery, so that the displacement unit and the valve units communicate with the central gallery, wherein the displacement unit has a displacement cavity therein, comprising:

closing all of the valve units and keeping the displacement unit in a minimum volume position of the displacement cavity;

opening one or more of the valve units and then increasing the displacement cavity to create a negative pressure inside the apparatus, so that the fluid in containers connected to the opened valve units flows through the opened valve units and fills the central gallery, the conduits, and the displacement cavity;

closing the opened valve units after the fluid fills the central gallery, the conduits, and the displacement cavity;

opening one or more of the valve units and decreasing the displacement cavity, so that the fluid in the central gallery, the conduits, and the displacement cavity flows through the newly opened valve units 330 to outside.

* * * * *